US010093088B2

(12) United States Patent
Fukuda

(10) Patent No.: US 10,093,088 B2
(45) Date of Patent: Oct. 9, 2018

(54) LIQUID DISCHARGING APPARATUS

(71) Applicant: SEIKO EPSON CORPORATION, Tokyo (JP)

(72) Inventor: Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/258,395

(22) Filed: Sep. 7, 2016

(65) Prior Publication Data

US 2017/0072695 A1 Mar. 16, 2017

(30) Foreign Application Priority Data

Sep. 10, 2015 (JP) ..... 2015-178236
Nov. 6, 2015 (JP) ..... 2015-218095

(51) Int. Cl.
*B41J 2/045* (2006.01)
*B41J 2/165* (2006.01)

(52) U.S. Cl.
CPC ..... *B41J 2/04513* (2013.01); *B41J 2/045* (2013.01); *B41J 2/04588* (2013.01); *B41J 2/04593* (2013.01); *B41J 2/16526* (2013.01); *B41J 2/16535* (2013.01)

(58) Field of Classification Search
CPC ..... B41J 2/04513; B41J 2/04588; B41J 2/04593; B41J 2/16526; B41J 2/045; B41J 2/16535
See application file for complete search history.

(56) References Cited

U.S. PATENT DOCUMENTS

2006/0192797 A1* 8/2006 Hosono ..... B41J 2/04516 347/8

FOREIGN PATENT DOCUMENTS

JP 2013-111767 A 6/2013

* cited by examiner

*Primary Examiner* — Justin Seo
(74) *Attorney, Agent, or Firm* — Foley & Lardner LLP

(57) ABSTRACT

Disclosed is a printer that forms dots on a recording medium using a recording head that discharges an ink, as liquid droplets, from a nozzle formation surface, in which a nozzle opening is formed, as a result of deforming a meniscus of the ink in the nozzle using a piezoelectric element. The printer includes a liquid-repellent film that covers the nozzle formation surface, and a wiping process that wipes away a stain on the nozzle formation surface. The printer forms dots on the recording medium using a first liquid droplet discharging operation that discharges ink, which is separated from a wall surface of the nozzle and disposed on an inner side of the nozzle, as liquid droplets.

2 Claims, 7 Drawing Sheets

LIQUID DISCHARGING APPARATUS

BACKGROUND

1. Technical Field

The present invention relates to a liquid discharging apparatus.

2. Related Art

In the related art, an ink jet type printer that records (prints) an image by discharging liquid droplets onto a recording medium from a liquid discharging head is known as an example of a liquid discharging apparatus.

A liquid discharging head includes a flow channel formation substrate in which a pressure generation chamber that accumulates a liquid is formed, a piezoelectric element that is formed on one surface side of the flow channel formation substrate, and a nozzle plate having a nozzle formation surface in which an opening of a nozzle, which is in communication with the pressure generation chamber, is formed. Further, dots are formed on a recording medium by discharging liquid droplets from the nozzle formation surface as a result of bringing about a pressure change in the liquid inside the pressure generation chamber by driving the piezoelectric element. However, a portion of the liquid droplets that are discharged from the nozzle formation surface does not land on the recording medium, and instead stains the nozzle formation surface as a result of turning into ink mist and becoming attached to the nozzle formation surface.

For example, in the ink jet type printer that is disclosed in JP-A-2013-111767, the durability of a nozzle plate is improved by covering a nozzle formation surface (an ejection surface) and a stepped portion of the outer periphery of the nozzle plate with a liquid-repellent film (water-repellent film). Furthermore, the ink jet type printer includes a member (a blade) that cleans by wiping the nozzle formation surface.

However, in the ink jet type printer that is disclosed in JP-A-2013-111767, when the cleaning of a stain (ink mist), which is attached to the nozzle formation surface, is repeated, there is a concern that the liquid-repellent film will deteriorate. To explain in more detail, there is a concern that the liquid-repellent film will be worn away mechanically as a result of cleaning the stain, which is attached to the nozzle formation surface, by wiping and that mechanical damage to the liquid-repellent film will occur as a result, a concern that the liquid-repellent film will be worn away chemically as a result of the stain, which is attached to the nozzle formation surface, and that chemical damage to the liquid-repellent film will occur as a result, and the like. When the liquid-repellent film deteriorates as a result of such mechanical damage or such chemical damage, a liquid droplet discharging performance of the liquid discharging head changes, and therefore, the appearance quality (image quality) of an image that is recorded on a recording medium by the liquid discharging head changes. Accordingly, it is difficult for the liquid discharging apparatus to be activated stably over a long period of time, and therefore, there is a concern that the durability of the liquid discharging apparatus will become impaired.

SUMMARY

The invention can be realized as the following aspects or application examples.

Application Example 1

According to this application example, there is provided a liquid discharging apparatus that forms dots on a recording medium by discharging a liquid, as liquid droplets, from a nozzle formation surface, in which an opening of a nozzle is formed, as a result of deforming a meniscus of the liquid in the nozzle using a piezoelectric element, the liquid discharging apparatus includes a liquid-repellent film that covers the nozzle formation surface, and a wiping process that wipes away a stain on the nozzle formation surface, and the dots are formed on the recording medium by a first liquid droplet discharging operation that discharges liquid, which is separated from a wall surface of the nozzle and disposed on an inner side of the nozzle, as liquid droplets.

An outer side (the nozzle formation surface) of the opening of the nozzle is covered by the liquid-repellent film, and the inner side of the opening of the nozzle is not covered by the liquid-repellent film. That is, the nozzle formation surface is covered by the liquid-repellent film up to the edge of the opening of the nozzle. Accordingly, liquid that is separated from the wall surface of the nozzle and disposed on the inner side of the nozzle, is liquid that is disposed separated from the edge of the opening of the nozzle, and therefore, is liquid that is disposed separated from the liquid-repellent film. Since the first liquid droplet discharging operation discharges liquid that is disposed separated from the liquid-repellent film as liquid droplets, it is difficult for the first liquid droplet discharging operation to be subjected to the effect of the liquid-repellent film in comparison with a case in which liquid that is disposed close to the liquid-repellent film is discharged as liquid droplets. Accordingly, even if the state of the liquid-repellent film changes (deteriorates) as a result of repeating the wiping process that wipes away a stain on the nozzle formation surface, it is difficult for the first liquid droplet discharging operation to be subjected to the effects of the deterioration of the liquid-repellent film, and therefore, the first liquid droplet discharging operation can discharge liquid droplets stably over a long period of time. Accordingly, the liquid discharging apparatus can be activated stably for a long period of time, and therefore, it is possible to improve the durability of the liquid discharging apparatus.

Furthermore, in comparison with a case in which liquid that is in contact with the wall surface of the nozzle and disposed on the inner side of the nozzle is discharged as liquid droplets, in a case in which liquid that is separated from the wall surface of the nozzle and disposed on the inner side of the nozzle is discharged as liquid droplets (the first liquid droplet discharging operation), the area (volume) of liquid of a portion that is discharged as liquid droplets is small, and therefore, the amount of liquid droplets that is discharged is small. Accordingly, in the first liquid droplet discharging operation, in comparison with a case in which liquid that is in contact with the wall surface of the nozzle and disposed on the inner side of the nozzle is discharged as liquid droplets, a small liquid droplet is discharged, small dots are formed on a recording medium, and it is possible to improve the resolution of an image that is formed on the recording medium.

Application Example 2

It is preferable that the liquid discharging apparatus according to the application example further includes a second liquid droplet discharging operation that discharges liquid, which is in contact with the wall surface of the nozzle and disposed on the inner side of the nozzle, as liquid droplets, and that the first liquid droplet discharging operation and the second liquid droplet discharging operation are used for different purposes depending on a deterioration state of the liquid-repellent film.

Liquid that is in contact with the wall surface of the nozzle and disposed on the inner side of the nozzle, is liquid that is disposed close to the edge of the opening of the nozzle, and therefore, is liquid that is disposed close to the liquid-repellent film. Since the second liquid droplet discharging operation discharges liquid that is disposed close to the liquid-repellent film as liquid droplets, it is easy for the second liquid droplet discharging operation to be subjected to the effect of the liquid-repellent film in comparison with the first liquid droplet discharging operation that discharges liquid that is disposed separated from the liquid-repellent film.

Furthermore, in comparison with the first liquid droplet discharging operation, in the second liquid droplet discharging operation, the area (volume) of liquid of a portion that is discharged as liquid droplets is large, and therefore, the amount of liquid droplets that is discharged is large. Accordingly, in comparison with the first liquid droplet discharging operation, in the second liquid droplet discharging operation a large liquid droplet is discharged, and it is possible to form large dots on a recording medium. For example, in a case of forming an image, in which high resolution is not required, on a recording medium, when the image is formed using the second liquid droplet discharging operation, in comparison with a case in which the image is formed using the first liquid droplet discharging operation, it is possible to improve productivity by shortening a formation time of the image that is formed on the recording medium.

In a case in which the liquid-repellent film is not deteriorated, it is possible to use both the first liquid droplet discharging operation and the second liquid droplet discharging operation. By using both the first liquid droplet discharging operation and the second liquid droplet discharging operation, it is possible to realize a liquid discharging apparatus that is capable of high-resolution image formation and high-productivity image formation.

In a case in which the liquid-repellent film is deteriorated, since it is easy for the second liquid droplet discharging operation to be subjected to the effects of the deterioration of the liquid-repellent film, it is difficult to form an image using the second liquid droplet discharging operation. Meanwhile, since it is difficult for the first liquid droplet discharging operation to be subjected to the effects of the deterioration of the liquid-repellent film, it is possible to form an image using the first liquid droplet discharging operation even in a case in which the liquid-repellent film is deteriorated. That is, in a case in which the liquid-repellent film is deteriorated, it is possible to realize a liquid discharging apparatus that can be activated stably for a long period of time by forming images using the first liquid droplet discharging operation.

In this manner, when the first liquid droplet discharging operation and the second liquid droplet discharging operation are used for different purposes depending on the deterioration state of the liquid-repellent film, in the liquid discharging apparatus, high-resolution image formation and high-productivity image formation are possible in a case in which the liquid-repellent film is not deteriorated, and stable activation over a long period of time is possible even in a case in which the liquid-repellent film is deteriorated.

Application Example 3

In the liquid discharging apparatus according to the application example, it is preferable that the dots are formed using both the first liquid droplet discharging operation and the second liquid droplet discharging operation in a case in which the deterioration state of the liquid-repellent film is negligible with respect to a predetermined state, and that the dots are formed using the first liquid droplet discharging operation only in a case in which the deterioration state of the liquid-repellent film is severe with respect to the predetermined state.

Since it is possible to use both the first liquid droplet discharging operation and the second liquid droplet discharging operation in a case in which the deterioration state of the liquid-repellent film is negligible with respect to the predetermined state, the liquid discharging apparatus can perform high-resolution image formation and high-productivity image formation.

Since it is possible to use the first liquid droplet discharging operation in a case in which the deterioration state of the liquid-repellent film is severe with respect to the predetermined state, the liquid discharging apparatus can be activated stably over a long period of time, and it is possible to improve the durability of the liquid discharging apparatus.

Application Example 4

It is preferable that the printing apparatus according to the application example further include an estimation section that estimates the deterioration state of the liquid-repellent film from the number of repetitions of the wiping process, that the dots are formed using both the first liquid droplet discharging operation and the second liquid droplet discharging operation in a case in which the estimation section estimates that the deterioration state of the liquid-repellent film is negligible with respect to the predetermined state, and that the dots are formed using the first liquid droplet discharging operation only in a case in which the estimation section estimates that the deterioration state of the liquid-repellent film is severe with respect to the predetermined state.

The wiping process is a process that wipes away a stain, which is attached to the liquid-repellent film that covers the nozzle formation surface, using a wiping member. As a result of the wiping process, it is easy for mechanical damage to the liquid-repellent film to occur, and it is easy for deterioration of the liquid-repellent film to progress. Therefore, a number of repetitions of the wiping process and the status of the progression of deterioration of the liquid-repellent film (the deterioration state of the liquid-repellent film) are correlated with one another, and therefore, it is possible to estimate the deterioration state of the liquid-repellent film using the number of repetitions of the wiping process. Accordingly, the estimation section can estimate the deterioration state of the liquid-repellent film from the number of repetitions of the wiping process.

It is possible to form an image using a preferable liquid droplet discharging operation on the basis of an estimation result of the deterioration state of the liquid-repellent film so that the liquid discharging apparatus uses both the first liquid droplet discharging operation and the second liquid droplet discharging operation in a case in which deterioration state of the liquid-repellent film is negligible with respect to the predetermined state, and uses the first liquid droplet discharging operation only in a case in which the deterioration state of the liquid-repellent film is severe with respect to the predetermined state.

Accordingly, the use of an unfavorable liquid droplet discharging operation is prevented from occurring, and therefore, it is possible to prevent the occurrence of loss due to the use of an unfavorable liquid droplet discharging operation.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. The embodiments illustrate aspects of the invention, but do not limit the invention, and can be changed arbitrarily within the range of the technical idea of the application.

Embodiment 1

Summary of Printer

Figure 1:
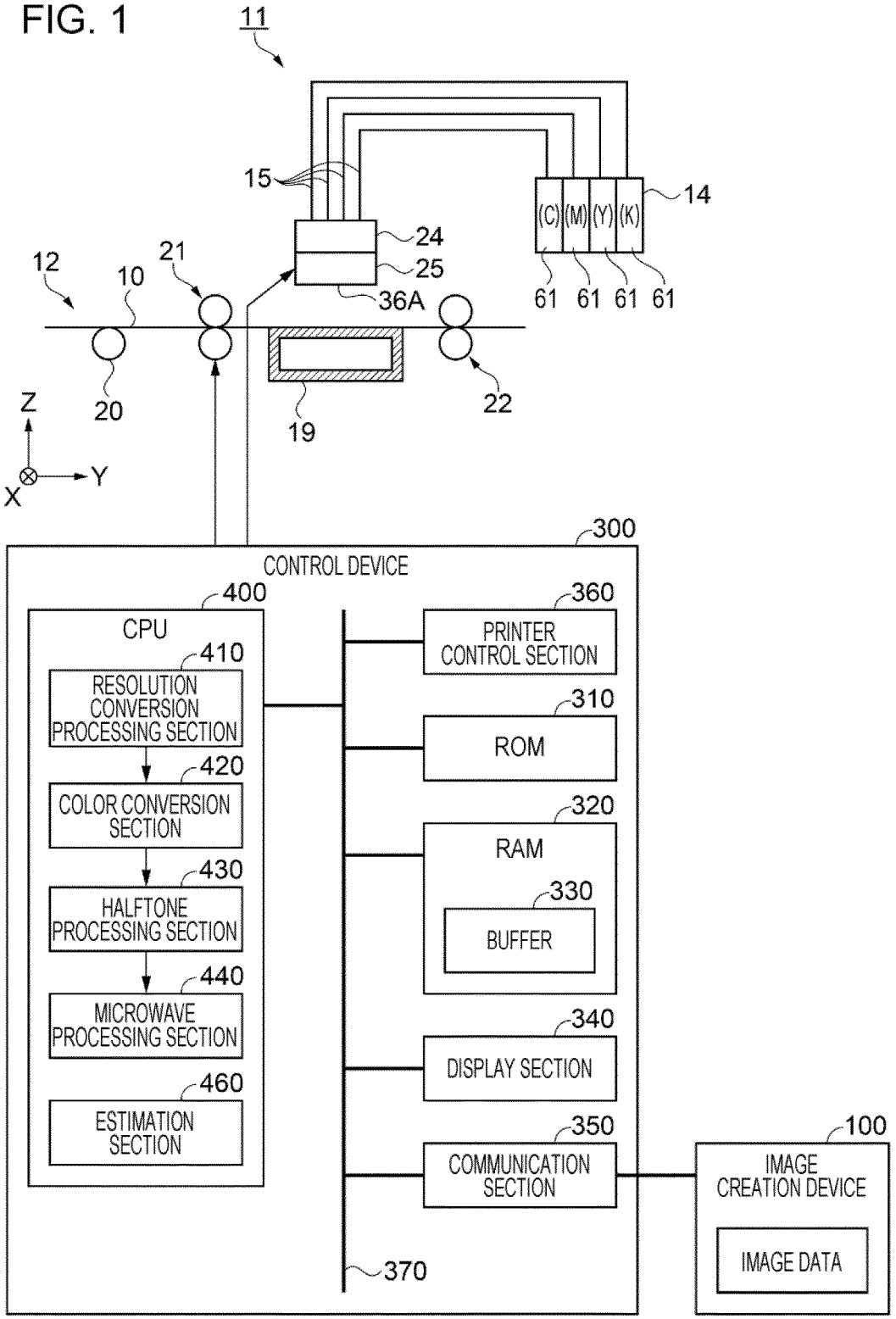
FIG. 1 is a schematic view that shows a summary of a printer according to Embodiment 1.

FIG. 1 is a schematic view that shows a summary of an ink jet type printer (hereinafter, referred to as a printer) according to Embodiment 1. Hereinafter, a summary of a printer 11 according to the present embodiment will be described with reference to FIG. 1.

As shown in FIG. 1, the printer 11 according to the present embodiment is provided with a transport unit 12 that transports a recording medium 10, and a recording head 25 that discharges an ink 61 onto the recording medium 10, which is transported by the transport unit 12. In addition, the printer 11 is provided with a control device 300 that controls the transport unit 12 and the recording head 25, four cartridges 14 that supply the ink 61 to the recording head 25, and a valve unit 24 that controls the flow pressure of the ink 61, which is supplied to the recording head 25.

The printer 11 is an example of a "liquid discharging apparatus", and the ink 61 is an example of a "liquid".

The transport unit 12 is provided with a paper feeding roller 20, transport motor (not illustrated in the drawing), a pair of transport rollers 21, a support section 19, a pair of paper ejection rollers 22, and the like, and transports the recording medium 10 in a transport direction (a Y direction) by a predetermined transport amount. The paper feeding roller 20 feeds the recording medium 10 inside the printer 11. The pair of transport rollers 21 transport the recording medium 10, which is fed by the paper feeding roller 20, up to a region above the support section 19 in which printing is possible. The support section 19 supports the recording medium 10 during printing. The pair of paper ejection rollers 22 eject the recording medium 10 to an ejection port (not illustrated in the drawing). The paper feeding roller 20, the pair of transport rollers 21 and the pair of paper ejection rollers 22 are driven by the transport motor.

The valve unit 24 and the recording head 25 are mounted in a carriage unit (not illustrated in the drawing), and as a result of the carriage unit, are capable of reciprocating in a scanning direction (an X direction), which intersects the transport direction. A nozzle opening 51 (refer to FIG. 2) that discharges the ink 61 onto the recording medium 10, is formed in the recording head 25, in a nozzle formation surface 36A, which faces a transport pathway of the recording medium 10.

The ink 61 includes a color material, a solvent in which a color material is dispersed (or dissolved), or the like.

For example, the color material can be a pigment, and it is possible to use an azo pigment such as an insoluble azo pigment, a condensed azo pigment, an azo lake, or a chelate azo pigment, a polycyclic pigment such as a phthalocyanine pigment, a perylene or perinone pigment, an anthraquinone pigment, a quinacridone pigment, a dioxane pigment, a thioindigo pigment, an isoindoline pigment, or a quinophthalone pigment, a dye chelates, a color lake, a nitro pigment, a nitroso pigment, an aniline black, a daylight fluorescent pigment, carbon black, a base metal pigment, or the like.

Furthermore, for example, as the color material, it is possible to use an inorganic material (a black pigment) such as copper oxide or manganese dioxide, and for example, an inorganic material (a white pigment) such as zinc white, titanium oxide, antimony white, zinc sulphide, or the like.

For example, the color material can be a dye, and it is possible to use a direct dye, an acid dye, a food dye, a basic dye, a reactive dye, a disperse dye, a vat dye, a soluble vat dye, a reactive disperse dye, or the like.

For example, the solvent can be a water-based medium, and it is possible to use pure water or high-purity water such as ion-exchanged water, ultrafiltration water, reverse osmosis water and distilled water. In addition, if water that is sterilized through the irradiation of ultraviolet rays or the addition of a hydrogen peroxide, is used, it is possible to prevent growth of mold, bacteria, and the like in a case in which the ink 61 is preserved over a long period of time.

For example, the solvent may include a volatile water soluble organic solvent such as ethylene glycol or propylene glycol.

Furthermore, in addition to the above-mentioned color material and solvent, the ink 61 may include a basic catalyst, a surfactant, a tertiary amine, a resin, a pH adjuster, a buffer solution, a fixing agent, an antiseptic, an antioxidant or an ultraviolet absorber, a chelating agent, an oxygen absorber, or the like.

Four colors of the ink 61 of cyan (C), magenta (M), yellow (Y) and black (K), are accommodated in the four cartridges 14. The cartridges 14 are electrically connected to the recording head 25 via four ink supply paths 15 and the valve unit 24. The ink 61 of the four colors of cyan (C), magenta (M), yellow (Y) and black (K) is supported to the valve unit 24 in a state of being pressurized by a supply pump (not illustrated in the drawing). The valve unit 24 adjusts the flow pressure of the ink 61 that is supplied to the recording head 25. For example, in a case in which a recording process is being executed, the valve unit 24 ensures that the ink 61 does not leak out from the nozzle opening 51 by adjusting the flow pressure of the ink 61 so that a negative pressure is applied to the ink 61 inside the recording head 25.

From this point onwards, the scanning direction will be referred to as the X direction and the transport direction will be referred to as the Y direction. A direction that is orthogonal to the X direction and the Y direction, that is, a direction that faces the recording head 25 from the support section 19 will be referred to as a Z direction. Furthermore, tip end sides of the arrows that show the directions are set as (+) directions, and base end sides of the arrows that show the directions are set as (−) directions.

The printer 11 executes a recording process that forms a predetermined image on the recording medium 10 by forming dots on the recording medium 10 due to alternate repetition of a liquid droplet discharging operation that discharges the ink 61 from the recording head 25, as liquid droplets 63A (refer to FIG. 5D) and liquid droplets 63B (refer to FIGS. 6B to 6D), during movement in the X direction, and a transport operation that moves the recording medium 10 in the Y direction. The details will be described later, but the recording head 25 includes, 360 nozzles 52 along the Y direction, which are respectively capable of discharging the four colors of ink 61, and can form rows of a maximum of 356 dots in the X direction as a result of a single liquid droplet discharging operation.

From this point onwards, a row of dots that is lined up in a scanning direction X by a liquid droplet discharging operation will be referred to as a raster line, and furthermore, there are cases in which a liquid droplet discharging operation of the recording head 25 will be referred to as a pass. In other words, the recording head 25 can form a raster line of a maximum of 356 dots with a single liquid droplet discharging operation (pass). Further, the printer 11 executes a recording process by aligning raster lines in the Y direction through alternate repetition of a liquid droplet discharging operation and the transport operation.

The control device 300 is provided with a CPU 400, a ROM 310, a RAM 320, a display section 340, a communication section 350 and a printer control section 360. The CPU 400, the ROM 310, the RAM 320, the communication section 350 and the printer control section 360 are connected to one another through a bus 370.

The CPU 400 performs image processes that are required in printing control by executing a program that is stored in the ROM 310. For example, the image processes include a resolution conversion process, a color conversion process, a microwave process, and the like.

Various programs and various information that is required in printing control are saved in the ROM 310.

The RAM 320 includes a buffer 330, and for example, temporarily stores various data, which is a calculation result, a process result, or the like, of the CPU 400.

For example, the display section 340 is configured by a liquid crystal display device that includes a touch panel.

For example, the communication section 350 receives image data for printing that an image creation device 100, which is configured by an information processing apparatus such as a personal computer, creates, and transmits image data to a resolution conversion process section 410.

The CPU 400 is provided with the resolution conversion process section 410, a color conversion section 420, a halftone process section 430, a microwave process section 440, an estimation section 460, and the like as functional portions that are realized by software (programs).

The resolution conversion process section 410 receives image data from the communication section 350, and executes a resolution conversion process that converts the image data into a resolution when printing on the recording medium 10. For example, in a case in which a printing resolution is designated as 1440×720 dpi, image data transmitted from the communication section 350 is converted into image data with a resolution of 1440×720 dpi. Each item of pixel data of the image data after the resolution conversion process, is data that indicates a gradation value of 256 gradations of an RGB color space that is formed from color components of the three colors of red (R), green (G) and blue (B).

The color conversion section 420 executes a color conversion process that converts image data, which is formed from gradation values of R, G and B that are received from the resolution conversion process section 410, into CMYK image data, which is data of gradation values of each color of cyan (C), magenta (M), yellow (Y) and black (K) that is used in the printer 11.

The halftone process section 430 executes a halftone process that converts pixel data of 256 gradations, which is received from the color conversion section 420, into pixel data of four gradations, which is a number of gradations that the printer 11 can form. That is, the halftone process section 430 individually performs a halftone process for each color of image data. Pixel data of four gradations after the halftone process corresponds to dot data that indicates a size of a dot that is formed in a corresponding pixel. More specifically, the pixel data is dot data that corresponds to large dot, medium dot, small dot or no dot.

Dot data that is created by the halftone process section 430 is raster data for forming dots of a raster line. Dot data created by the halftone process section 430 is temporarily stored (saved) in the buffer 330 of the RAM 320. In other words, raster data on which the halftone process is performed, is stored in the buffer 330.

The microwave process section 440 receives required dot data (raster data) from the buffer 330, and executes a microwave process that creates recording data of each pass by performing an interlacing process. The interlacing process is a process that creates recording data of each pass by rearranging dot data (raster data) into a sequence that should be transferred to the printer control section 360 while taking a dot formation sequence into consideration.

In this manner, the CPU 400 creates recording data that is required in printing by carrying out the above-mentioned resolution conversion process, the color conversion process, the halftone process and the microwave process.

Further, the printer control section 360 executes a recording process by reading recording data of each pass, and aligning raster lines in the Y direction through alternate repetition of a liquid droplet discharging operation and the transport operation by controlling the transport unit 12 and the recording head 25. In addition, in the liquid droplet discharging operation, three types of dot of different sizes (a large dot, a medium dot and a small dot) are formed on the recording medium 10 on the basis of pixel data of four gradations after the halftone process.

Additionally, the details of the estimation section 460 will be described later.

Recording Head

Figure 2:
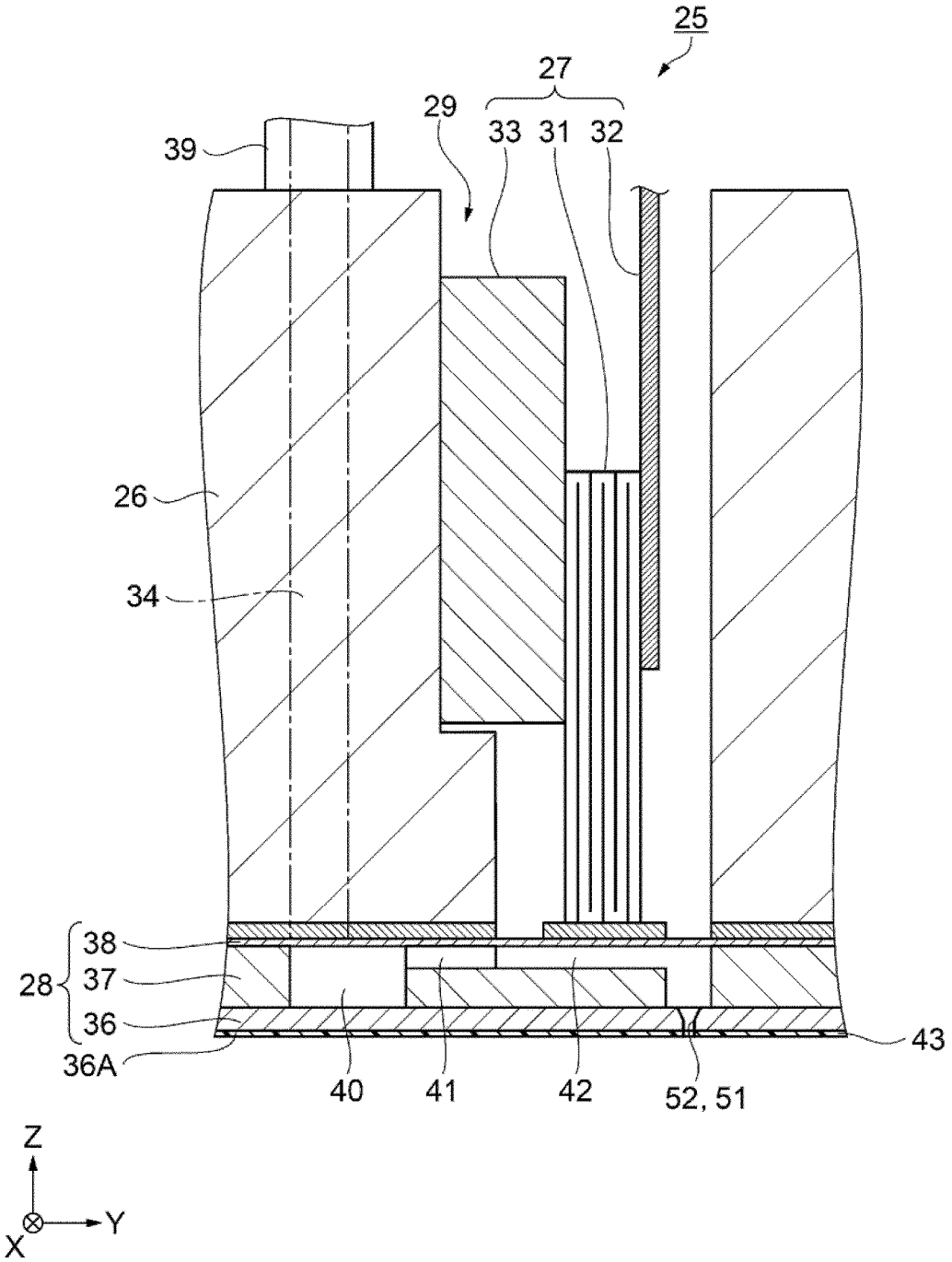
FIG. 2 is a main portion cross-sectional view of a recording head.
Figure 3:
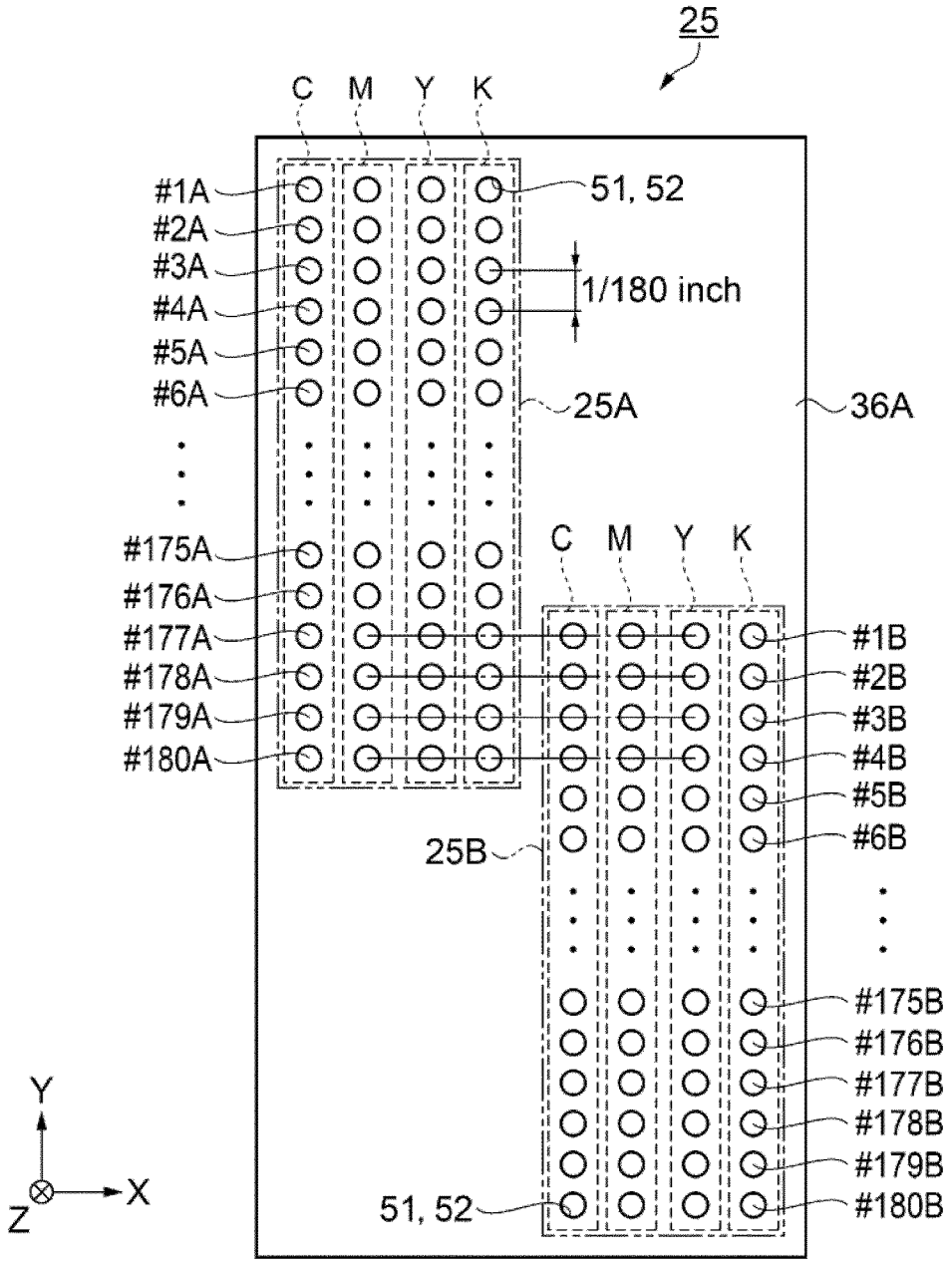
FIG. 3 is a schematic plan view of the recording head that shows a state of nozzle openings that are formed in a nozzle formation surface.

FIG. 2 is a main portion cross-sectional view of a recording head. FIG. 3 is a schematic plan view of the recording head that shows a state of nozzle openings that are formed in a nozzle formation surface.

Additionally, in order to facilitate understanding of the state of the recording head 25, in FIG. 2, a single nozzle 52 is illustrated in the recording head 25 and the illustration of the other nozzles 52 is omitted.

Next, the configuration of the recording head 25 will be described with reference to FIG. 2.

As shown in FIG. 2, the recording head 25 includes a head case 26, a vibration element unit 27, and a flow channel unit 28.

The head case 26 is a hollow box-shaped member, and the flow channel unit 28 is fixed to a tip end surface (the lower surface) thereof. The vibration element unit 27 is accommodated inside an accommodation space section 29, which is formed in an inner section of the head case 26. A case flow channel 34 is formed in an inner section of the head case 26 penetrating through the height direction thereof. The case flow channel 34 is a flow channel for the introduction of the ink 61, which is supplied from the cartridges 14, into a common ink chamber 40, and one end thereof is connected to the common ink chamber 40. In addition, the other end of the case flow channel 34 is connected to an ink lead-out port (not illustrated in the drawings) of the valve unit 24 via a gasket 39.

The vibration element unit 27 is configured by a plurality of piezoelectric elements 31, which are lined up in comb tooth form, a flexible cable 32 for supplying driving signals to the piezoelectric elements 31 from a driving substrate (not illustrated in the drawings), and a fixing plate 33 that fixes the piezoelectric elements 31. The piezoelectric elements 31 are joined to a flexible surface (a vibration plate 38) that partitions a portion of a pressure generation chamber 42.

The piezoelectric elements 31 are longitudinal vibration mode piezoelectric actuators that extend and contract in an axial direction. The piezoelectric elements 31 contract when charged, and extend when discharged. Accordingly, in the recording head 25, the piezoelectric elements 31 contract as a result of being charged, the vibration plate 38 is displaced in the Z (+) direction in accordance with the contraction, and the pressure generation chamber 42 expands. In accordance with this expansion, the pressure of the ink 61 in the pressure generation chamber 42 decreases, and the ink 61 of the common ink chamber 40 flows into the pressure generation chamber 42 through an ink supply port 41. Meanwhile, the piezoelectric elements 31 extend as a result of being discharged, the vibration plate 38 is displaced in the Z (−) direction, and the pressure generation chamber 42 contracts. In accordance with this contraction, the pressure of the ink 61 in the pressure generation chamber 42 increases.

Additionally, the piezoelectric elements 31 may be flexural vibration mode piezoelectric actuators.

The flow channel unit 28 has a configuration in which a nozzle formation plate 36, in which the nozzles 52 are provided, a flow channel formation substrate 37 that forms ink flow channels, and the vibration plate 38 that seals an opening surface of the flow channel formation substrate 37, are joined together and integrated in a state in which these components are laminated. The flow channel unit 28 is a unit member that forms a series of ink flow channels (liquid flow channels) from the common ink chamber 40 to the nozzles 52 passing through the ink supply port 41 and the pressure generation chamber 42. The pressure generation chamber 42 is branched from the common ink chamber 40, and is formed for each nozzle 52. The ink 61 that is lead out from the ink lead-out port of the valve unit 24 is supplied to the pressure generation chamber 42 via the common ink chamber 40. The flow channel unit 28 is joined to a tip end surface of the head case 26 in a posture in which the nozzle formation plate 36 faces a lower side (the Z (−) direction).

The opening 51 (referred to as the nozzle opening 51 from this point onwards) of the nozzle 52, which is a discharge port of the liquid droplets 63A and 63B, is formed on the nozzle formation surface 36A of a lower side (the Z (−) direction) of the nozzle formation plate 36. The nozzle formation surface 36A is covered by a liquid-repellent film 43.

For example, the liquid-repellent film 43 can be formed from a fluorine-containing organic compound, a fluorine-containing organosilicon compound, or the like. For example, if the liquid-repellent film 43 is formed using a fluorine-containing organosilicon compound, since a hydroxyl group of the nozzle formation surface 36A and a hydrolyzable group of the fluorine-containing organosilicon compound or the like, bond together strongly, it is possible to improve the adhesive properties of the nozzle formation surface 36A and the liquid-repellent film 43. In terms of the liquid repellency of the liquid-repellent film 43, it is preferable that a contact angle of pure water with respect to the liquid-repellent film 43 is 40° or more.

As shown in FIG. 3, the recording head 25 includes two nozzle groups 25A and 25B. In the recording head 25, the first nozzle group 25A functions as a first head, and the second nozzle group 25B functions as a second head. Four nozzle rows are provided in each nozzle group. Nozzle openings 51 (nozzles 52) that respectively discharge the ink 61 of cyan (C), magenta (M), yellow (Y) and black (K), are formed on the lower surface of the recording head 25 (the nozzle formation surface 36A of the nozzle formation plate 36), in the four nozzle rows.

To explain in more detail, 180 nozzle openings 51 (nozzle openings 51 #1 to #180) are provided aligned along the Y direction in each nozzle row at a pitch of 180 dpi. Furthermore, the piezoelectric elements 31 are provided on the pressure generation chambers 42, which are in communication with the 180 nozzle openings 51 (the nozzles 52), as driving elements for discharging the ink 61 from each nozzle opening 51.

The first nozzle group 25A is provided further on a downstream side in the transport direction (a Y (+) direction side) than the second nozzle group 25B. In addition, the first nozzle group 25A and the second nozzle group 25B are provided so that the positions of four nozzle openings 51 in the transport direction (the Y direction) overlap. For example, in the Y direction, the position of a nozzle opening 51 #177A of the first nozzle group 25A is the same as the position of a nozzle opening 51 #1B of the second nozzle group 25B. As a result of this, in a given liquid droplet discharging operation, when the nozzle opening 51 #177A of the first nozzle group 25A is capable of forming a dot in a given pixel, it is also possible to form a dot in the pixel with the nozzle opening 51 #1B of the second nozzle group 25B.

Liquid Droplet Discharging Operation

Figure 4:
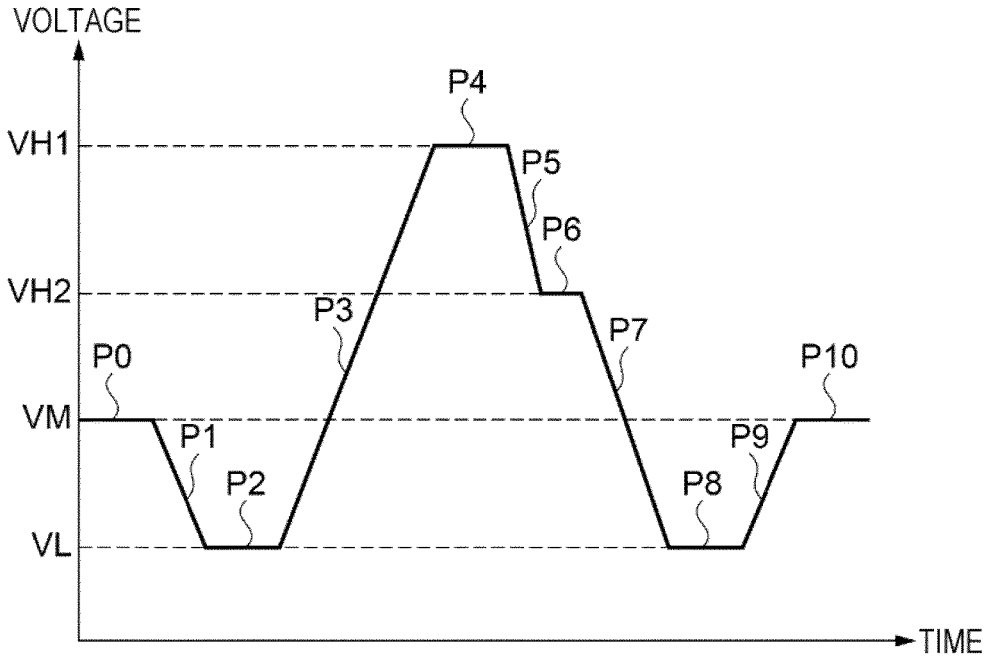
FIG. 4 is a schematic diagram that shows a state of a driving signal that is supplied to a piezoelectric element.

FIG. 4 is a schematic diagram that shows a state of a driving signal that is supplied to a piezoelectric element. FIGS. 5A to 5D are schematic diagrams that show states of a first liquid droplet discharging operation. FIGS. 6A to 6D are schematic diagrams that show states of a second liquid droplet discharging operation.

As shown in FIGS. 5A to 5D and 6A to 6D, the nozzle formation plate 36 includes the nozzle formation surface 36A in which the nozzle 52 and the nozzle opening 51 are formed. The nozzle formation surface 36A is covered by the liquid-repellent film 43. The inner side of the nozzle 52 is filled with the ink 61, and the ink 61 is surrounded by a wall surface 53 of the nozzle 52.

An outer side (the nozzle formation surface 36A) of the nozzle opening 51 is covered by the liquid-repellent film 43, and the inner side (the wall surface 53 of the nozzle 52) of the nozzle opening 51 is not covered by the liquid-repellent film 43. That is, in the nozzle formation surface 36A, the liquid-repellent film 43 covers up to an opening edge of the nozzle opening 51. Accordingly, the opening edge of the nozzle opening 51 is a boundary between a portion that is covered by the liquid-repellent film 43 and a portion that is not covered by the liquid-repellent film 43. Since the affinity with respect to the ink 61 differs for the portion that is covered by the liquid-repellent film 43 and the portion that is not covered by the liquid-repellent film 43, a meniscus 62 of the ink 61 is formed at the boundary (the opening edge of the nozzle opening 51) between the portion that is covered by the liquid-repellent film 43 and the portion that is not covered by the liquid-repellent film 43.

The meniscus 62 is a free surface of the ink 61 that is exposed from the nozzle opening 51, and is formed at the opening edge of the nozzle opening 51. The liquid-repellent film 43 controls the position and shape of the meniscus 62, and has a role of discharging the liquid droplets 63A and 63B stably from the nozzle formation surface 36A. Furthermore, the liquid-repellent film 43 also has a role of making it difficult for the ink 61 to become attached to the nozzle formation surface 36A.

Firstly, a first liquid droplet discharging operation will be described with reference to FIG. 4 and FIGS. 5A to 5D.

The printer control section 360 supplies a driving signal (FIG. 4) for executing the first liquid droplet discharging operation to the piezoelectric elements 31. In the driving signal for executing the first liquid droplet discharging operation, which is shown in FIG. 4, a starting point (P0) of the signal and an end point (P10) of the signal are set to an intermediate driving voltage VM, and a driving signal between a minimum driving voltage VL and a maximum driving voltage VH1 is supplied to the piezoelectric elements 31.

The driving signal that is supplied to the piezoelectric elements 31 is provided with (1) contraction signals (P1 and P2) that lower the voltage from the intermediate driving voltage VM to the minimum driving voltage VL and push out the meniscus 62 by contracting the pressure generation chamber 42, (2) preparation signals (P3 and P4) that draw in the meniscus 62 by raising the voltage from the minimum driving voltage VL to the maximum driving voltage VH1 and expanding the pressure generation chamber 42, (3) discharge signals (P5 and P6) that discharge a liquid droplet 63A by lowering the voltage to a voltage VH2 of an intermediate point between the VL and the VH1 and contracting the pressure generation chamber 42, (4) a subordinate signal (P7) that suppresses residual vibrations of the meniscus 62 by lowering the voltage to the minimum driving voltage VL in a comparatively gradual manner after discharge and contracting the pressure generation chamber 42, and (5) reversion signals (P8 and P9) that return the pressure generation chamber 42 to the original volume thereof by reverting the voltage to the intermediate driving voltage VM again.

The first liquid droplet discharging operation is executed by supplying the corresponding driving signal to the piezoelectric elements 31. To explain in more detail, the first liquid droplet discharging operation includes (1) an operation that pushes out the meniscus 62 by contracting the pressure generation chamber 42 (FIG. 5B), (2) an operation that draws in the meniscus 62 by expanding the pressure generation chamber 42 (FIG. 5C), (3) an operation that discharges a liquid droplet 63A by contracting the pressure generation chamber 42 (FIG. 5D), (4) an operation that suppresses residual vibrations of the meniscus 62 by contracting the pressure generation chamber 42, and (5) an operation that returns the pressure generation chamber 42 to the original volume thereof.

Figure 5A:
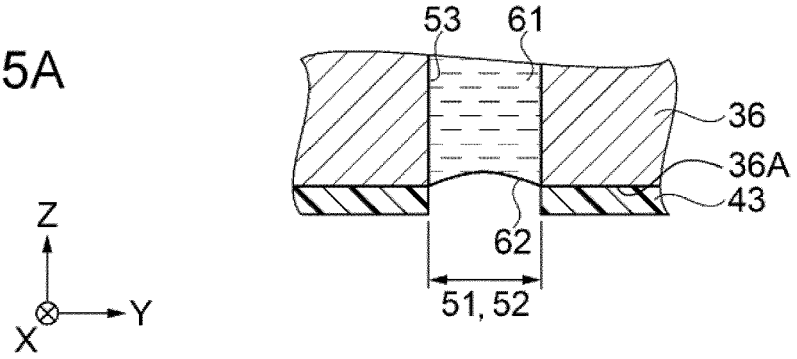
FIG. 5A is a schematic diagram that shows a state of a first liquid droplet discharging operation.

In a standby state (P0) in which a recording process (liquid droplet discharge) is not being executed, the above-mentioned valve unit 24 (refer to FIG. 1) adjusts the flow pressure of the ink 61 so that a negative pressure is applied to the ink 61 inside the recording head 25. Therefore, in the standby state (P0), as shown in FIG. 5A, the meniscus 62 is in a state of being slightly drawn-in to an inner side of the nozzle opening 51.

Figure 5B:
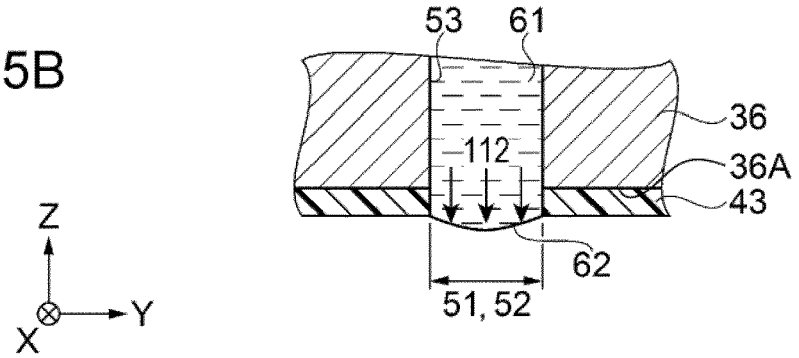
FIG. 5B is a schematic diagram that shows a state of the first liquid droplet discharging operation.

In the operation that pushes out the meniscus 62 by contracting the pressure generation chamber 42, as shown in FIG. 5B, the contraction signals (P1 and P2) are supplied to the piezoelectric elements 31, the pressure generation chamber 42 is contracted by extending the piezoelectric elements 31, and the meniscus 62 is pushed out to an outer side of the nozzle opening 51 in a direction of the arrows 112.

Figure 5C:
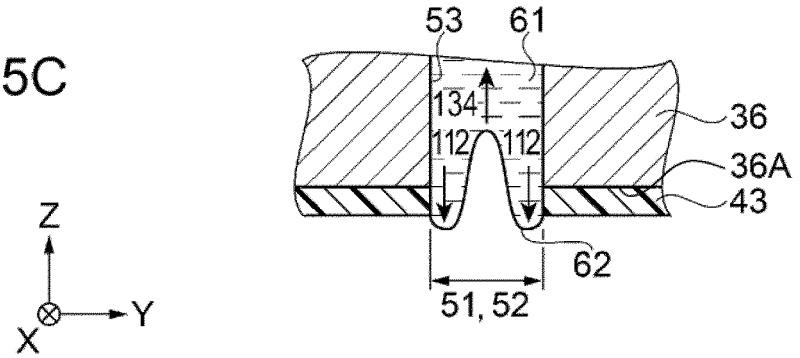
FIG. 5C is a schematic diagram that shows a state of the first liquid droplet discharging operation.

In the operation that draws in the meniscus 62 by expanding the pressure generation chamber 42, as shown in FIG. 5C, the preparation signals (P3 and P4) are supplied to the piezoelectric elements 31, the pressure generation chamber 42 is expanded by contracting the piezoelectric elements 31, and the meniscus 62 is drawn in to an inner side of the nozzle opening 51. At this time, since the meniscus 62, which is being pushed out by the contraction signals (P1 and P2), is drawn-in, the vicinity of a central portion of the meniscus 62 is drawn in a localized manner in a direction of an arrow 134. In addition, pressure in the direction of the arrows 112 remains in the same manner as before in the vicinity of the of the wall surface 53 of the nozzle opening 51.

That is, the ink 61 that is separated from the wall surface 53 of the nozzle 52 and disposed on the inner side of the nozzle 52, is drawn in the direction of the arrow 134 in a localized manner.

Figure 5D:
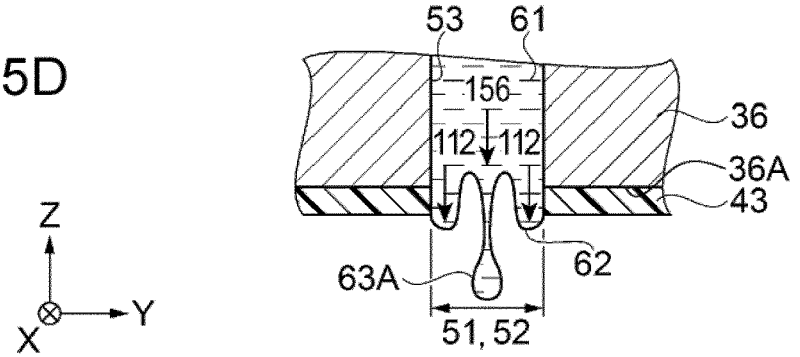
FIG. 5D is a schematic diagram that shows a state of the first liquid droplet discharging operation.

In the operation that discharges a liquid droplet 63A by contracting the pressure generation chamber 42, as shown in FIG. 5D, the discharge signals (P5 and P6) are supplied to the piezoelectric elements 31, the pressure generation chamber 42 is rapidly contracted by extending the piezoelectric elements 31, the pressure of the ink 61 inside the pressure generation chamber 42 is increased, and a liquid droplet 63A is discharged by squirting out the ink 61 of a microscopic region in the vicinity of the center of the meniscus 62 that is drawn-in in a localized manner, in a direction of an arrow 156 (the Z (−) direction). At this time, it is possible to discharge a liquid droplet 63A that is extremely minute in comparison with the diameter of the nozzle opening 51, at high speed.

In the operation that suppresses residual vibrations of the meniscus 62 by contracting the pressure generation chamber 42, the subordinate signal (P7) is supplied to the piezoelectric elements 31, the piezoelectric elements 31 are extended further, the pressure generation chamber 42 is contracted to the volume thereof before input of the preparation signals, at a comparatively slow speed of an extent at which a liquid droplet 63A is not discharged by the pressure generation chamber 42, and residual vibrations of the meniscus 62 are suppressed during this period (not illustrated in the drawing).

In the operation that returns the pressure generation chamber 42 to the original volume thereof, the reversion signals (P8 and P9) are supplied to the piezoelectric elements 31, the piezoelectric elements 31 are contracted, and the pressure generation chamber 42 is expanded until the pressure generation chamber 42 reaches a volume that is the same as that of the standby state (P0).

In this manner, before the supply of the discharge signals (P5 and P6), since the meniscus 62 is drawn in after being temporarily pushed out by the contraction signals (P1 and P2) that push out the meniscus 62 and the preparation signals (P3 and P4) that draw in the meniscus 62, the vicinity of the center of the meniscus 62 is drawn in a localized manner. Since the pressure generation chamber 42 is contracted by supplying the discharge signals (P5 and P6) in this state, the ink 61 of a microscopic portion in the vicinity of the center of the meniscus 62 that is drawn-in in a localized manner, is squirted out as a liquid droplet 63A. Accordingly, even if the diameter of the nozzle opening 51 is not reduced, it is possible to discharge an extremely minute liquid droplet 63A, and therefore, it is possible to realize printing having a high resolution. Additionally, the speed of a liquid droplet 63A that is discharged is fast, and therefore, it is possible to improve the precision of a landing position, and the like.

In this manner, in the first liquid droplet discharging operation, the ink 61 of a microscopic region in the vicinity of the center of the meniscus 62 that is drawn-in a localized manner, is discharged in the Z (−) direction as a liquid droplet 63A. In other words, in the first liquid droplet discharging operation, the ink 61 that is separated from the wall surface 53 of the nozzle 52 and disposed on the inner side of the nozzle 52, is discharged in the Z (−) direction as a liquid droplet 63A.

Since the first liquid droplet discharging operation discharges the ink 61 of a microscopic region in the vicinity of the center of the meniscus 62 as a liquid droplet 63A, in comparison with the second liquid droplet discharging operation, which will be described later, the size of a liquid droplet that is discharged is small, and among the above-mentioned three types of dot of different sizes (a large dot, a medium dot and a small dot), a small dot is formed on the recording medium 10.

Additionally, the driving signal for executing the first liquid droplet discharging operation is not limited to the driving signal that is shown in FIG. 4, and may be any kind of driving signal that is capable of discharging the ink 61 of a microscopic region in the vicinity of the center of the meniscus 62 that is drawn-in in a localized manner, in the Z (−) direction as a liquid droplet 63A. Furthermore, the driving signal for executing the first liquid droplet discharging operation is not limited to the single type that is shown in FIG. 4, and may also include a plurality of types.

Next, a second liquid droplet discharging operation will be described with reference to FIGS. 6A to 6D.

Figure 6A:
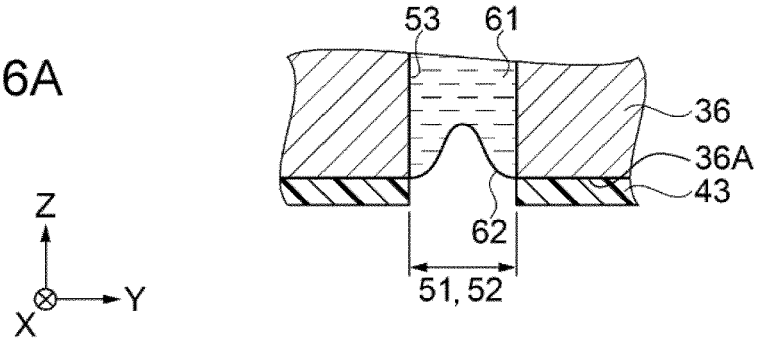
FIG. 6A is a schematic diagram that shows a state of a second liquid droplet discharging operation.
Figure 6B:
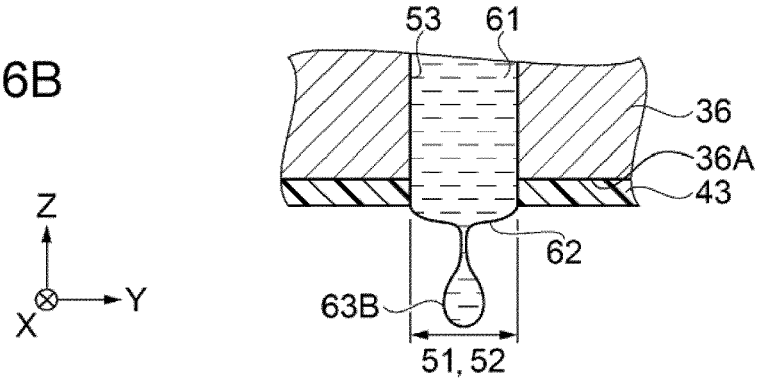
FIG. 6B is a schematic diagram that shows a state of the second liquid droplet discharging operation.
Figure 6C:
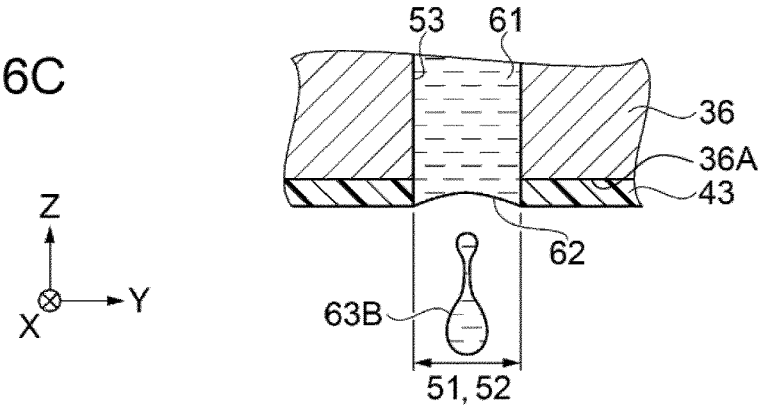
FIG. 6C is a schematic diagram that shows a state of the second liquid droplet discharging operation.
Figure 6D:
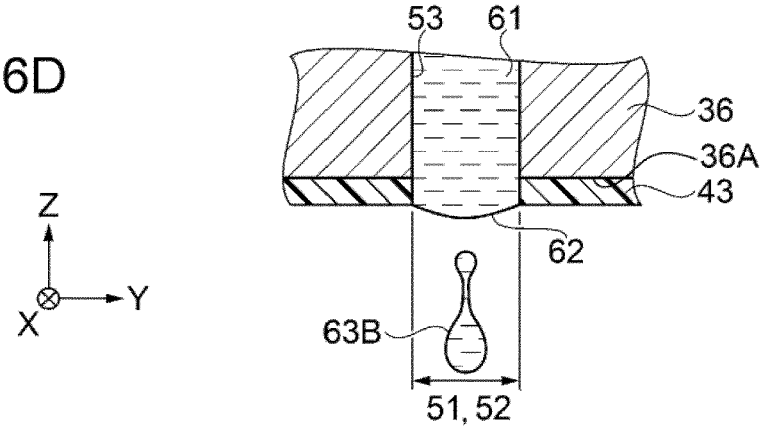
FIG. 6D is a schematic diagram that shows a state of the second liquid droplet discharging operation.

The second liquid droplet discharging operation includes a first expansion operation (FIG. 6A), a first contraction operation (FIG. 6B), and a second contraction operation (FIGS. 6C and 6D).

In the first expansion operation, as shown in FIG. 6A, the piezoelectric elements 31 are contracted, the pressure generation chamber 42 is expanded, and the meniscus 62 of the ink 61 is drawn in greatly to a pressure generation chamber 42 side.

In the first contraction operation, as shown in FIG. 6B, the piezoelectric elements 31 are extended, the pressure generation chamber 42 is contracted, the entirety of the meniscus 62 is squirted out as a result of the recoil of the drawing in of the meniscus 62 in the first expansion operation, and pushing out of the meniscus 62 due to contraction of the pressure generation chamber 42, and the ink 61 that is in contact with the wall surface 53 of the nozzle 52 and disposed on the inner side of the nozzle 52, is discharged in the Z (−) direction as a liquid droplet 63B.

Subsequently, the second contraction operation, which further contracts the pressure generation chamber 42, is executed. Drawing-in of the meniscus 62 due to the recoil of the first contraction operation, as shown in FIG. 6C, is reduced as a result of the second contraction operation. Furthermore, elevation of the meniscus 62 after discharge of a liquid droplet 63B, as shown in FIG. 6D, is reduced as a result of the second contraction operation. In this manner, the second contraction operation reduces drawing-in of the meniscus 62 and elevation of the meniscus 62 after discharge of a liquid droplet 63B by the second contraction operation.

Subsequently, the pressure generation chamber 42 is contracted to the volume thereof before the first expansion operation, at a comparatively slow speed of an extent at which a liquid droplet 63B is not discharged, and residual vibrations of the meniscus 62 are suppressed during this period (not illustrated in the drawing).

In the second liquid droplet discharging operation, since a liquid droplet 63B is discharged by squirting out the entirety of the meniscus 62, in comparison with the first liquid droplet discharging operation that discharges a liquid droplet 63A by squirting out a microscopic region in the vicinity of the center of the meniscus 62, the size of a liquid droplet that is discharged is large, and among the above-mentioned three types of dot of different sizes (a large dot, a medium dot and a small dot), a medium dot or a large dot is formed on the recording medium 10. In other words, in the second liquid droplet discharging operation, the ink 61 that is in contact with the wall surface 53 of the nozzle 52 and disposed on the inner side of the nozzle 52, is discharged in the Z (−) direction as a liquid droplet 63B, and among the above-mentioned three types of dot of different sizes (a large dot, a medium dot and a small dot), a medium dot or a large dot is formed on the recording medium 10.

In this manner, in the printer 11, the meniscus 62 of the ink 61 inside the nozzle 52 is deformed by the piezoelectric elements 31, the ink 61 is discharged from the nozzle formation surface 36A in which the nozzle openings 51 are formed, as liquid droplets 63A and 63B, and three types of dot of different sizes (a large dot, a medium dot and a small dot) are formed on the recording medium 10.

It is possible to form a plurality of small dots by repeating the first liquid droplet discharging operation, and a medium dot or a large dot can be formed by a corresponding plurality of small dots. Accordingly, in the first liquid droplet discharging operation, it is possible to form all of the three types of dot of different sizes (a large dot, a medium dot and a small dot).

On the other hand, in the second liquid droplet discharging operation, since it is difficult to form a small dot, it is difficult to form all of the three types of dot of different sizes (a large dot, a medium dot and a small dot).

When a medium dot or a large dot is formed by the first liquid droplet discharging operation, in comparison with a case in which a medium dot or a large dot is formed by the second liquid droplet discharging operation, a number of repetitions of discharge is high, and therefore, dot formation time is long. Accordingly, it is preferable that a medium dot or a large dot is formed by the second liquid droplet discharging operation in which the dot formation time is shorter.

Accordingly, it is preferable that an image that is configured by medium dots or large dots (an image in which high resolution is not required) is formed by the second liquid droplet discharging operation in which the dot formation time is shorter. That is, when an image that is configured by medium dots or large dots (an image in which high resolution is not required) is formed by the second liquid droplet discharging operation, in comparison with a case of forming with the first liquid droplet discharging operation, an image formation time is short, and therefore, it is possible to improve the productivity of image formation that is formed on the recording medium 10.

On the other hand, it is preferable that an image that is configured by small dots (an image in which high resolution is required) is formed by the first liquid droplet discharging operation. Since the first liquid droplet discharging operation forms a dot by discharging an extremely minute liquid droplet 63A, in comparison with the second liquid droplet discharging operation, a small dot is formed on the recording medium 10, and therefore, it is possible to improve the resolution of an image that is formed on the recording medium 10.

Maintenance Process

In the above-mentioned liquid droplet discharging operations, a portion of the liquid droplets 63A and 63B that are discharged from the nozzle formation surface 36A does not land on the recording medium 10, and instead forms ink mist, becomes airborne and becomes attached to the nozzle formation surface 36A. The nozzle formation surface 36A is covered by the liquid-repellent film 43, and it is difficult for the ink 61 to become attached thereto, but when the recording head 25 is used for a long period of time, the ink mist becomes attached to the nozzle formation surface 36A anyway, and the nozzle formation surface 36A becomes stained. Furthermore, when stain accumulates on the nozzle formation surface 36A, the performance of the recording head 25 deteriorates (changes).

Furthermore, the ink 61 that is supplied to the recording head 25 from the cartridges 14, is exposed to atmospheric air on the nozzle formation surface 36A, a solvent component of the ink 61 evaporates, and the viscosity of the ink 61 increases. Moreover, when the liquid droplet discharging operations are repeated, there are cases in which air bubbles become incorporated an ink flow channel of the recording head 25. The performance of the recording head 25 also deteriorates (changes) as a result of the thickening of the ink 61, the incorporation of air bubbles in the ink 61, and the like.

Therefore, in the printer 11, a maintenance process that restores the performance of the recording head 25 to a normal state is executed. The maintenance process is configured by a wiping process that wipes away a stain on the nozzle formation surface 36A using a wiping member (not illustrated in the drawing), and a flushing process that forcibly ejects thickened ink 61 and ink 61 in which air bubbles are incorporated from the recording head 25.

For example, the maintenance process is executed at a time of activation time of the printer 11, a time of interruption of the printer 11 and at regular intervals during non-execution of printing. Furthermore, the maintenance process is executed at irregular intervals at various timings such as a case in which a user performs an instruction of the maintenance process.

A stain attached to the nozzle formation surface 36A is either (1) a liquid with high flowability, (2) a gel with low flowability from which a portion of a solvent component of ink mist is evaporated, or (3) a solid material from which a solvent component of ink mist is evaporated. In a case in which a stain that is attached to the nozzle formation surface 36A is a solid material, in comparison with a case in which a stain that is attached to the nozzle formation surface 36A is a liquid or a gel, the stain is firmly attached to the nozzle formation surface 36A, and therefore, it is necessary wipe away the stain with a powerful force. When the wiping process is repeated with a powerful force, the liquid-repellent film 43 that covers the nozzle formation surface 36A is subjected to damage, and therefore, defects such as scuffs and peeling away, occur in the liquid-repellent film 43, and it is easy for the liquid-repellent film 43 to deteriorate.

Furthermore, even in a case in which a stain is weakly attached to the nozzle formation surface 36A and the stain is wiped away with a weak force, when the wiping process is repeated, deterioration of the liquid-repellent film 43 progresses gradually.

On the other hand, in the flushing process, since it is difficult for mechanical damage to the liquid-repellent film 43 occur, it is difficult for the liquid-repellent film 43 to deteriorate. That is, it is easy for deterioration of the liquid-repellent film 43 to progress as a result of the wiping process, and it is difficult for deterioration of the liquid-repellent film 43 to progress as a result of the flushing process.

Deterioration of the liquid-repellent film 43 does not progress uniformly on the nozzle formation surface 36A, and instead, in the liquid-repellent film 43 that covers the nozzle formation surface 36A, there are portions in which deterioration progresses rapidly, and portions in which deterioration progresses slowly. Therefore, in the nozzle formation surface 36A, there are portions that are covered by liquid-repellent film 43 that is heavily deteriorated, and portions that are covered by liquid-repellent film 43 that is lightly deteriorated. Furthermore, the state (shape) of the meniscus 62 that is formed at the opening edge of the nozzle opening 51, also changes at nozzle openings 51 that are disposed in portions in which the liquid-repellent film 43 is heavily deteriorated, and nozzle openings 51 that are disposed in portions in which the liquid-repellent film 43 is lightly deteriorated.

In the above-mentioned manner, in the printer 11, the meniscus 62 of the ink 61 inside the nozzle 52 is deformed by the piezoelectric elements 31, and the ink 61 is discharged from the nozzle formation surface 36A in which the nozzle openings 51 are formed, as liquid droplets 63A and 63B. Since there is a correlative relationship between the state (shape) of the meniscus 62 and the amounts of the liquid droplets 63A and 63B that are discharged, when the state (shape) of the meniscus 62 changes as a result of a deterioration state of the liquid-repellent film 43, even in a case in which the same driving voltage is supplied to the piezoelectric elements 31, the amounts of the liquid droplets 63A and 63B that are discharged, changes.

In the abovementioned manner, the nozzle formation surface 36A has 360 nozzle openings 51 along the Y direction, which are capable of discharging any one of the four colors of ink 61 (refer to FIG. 3). The nozzle formation surface 36A discharges the ink 61 from the respective 360 nozzle openings 51 as liquid droplets 63A and 63B, and three types of dot of different sizes (a large dot, a medium dot and a small dot) are formed on the recording medium 10.

When deterioration of the liquid-repellent film 43 progresses as a result of the wiping process, among the 360 nozzle openings 51 along the Y direction, which are capable of discharging any one of the four colors of ink 61, there are nozzle openings 51 that are disposed in portions in which the liquid-repellent film 43 is heavily deteriorated, and nozzle openings 51 that are disposed in portions in which the liquid-repellent film 43 is lightly deteriorated. Therefore, in the 360 nozzle openings 51 along the Y direction, which are capable of discharging any one of the four colors of ink 61, the respective discharge performances of the liquid droplets 63A and 63B, change. That is, the uniformity of the discharge performance of the 360 nozzle openings 51 is degraded.

In a case in which the discharge performance of the 360 nozzle openings 51 is uniform, when the same driving voltage is supplied to the piezoelectric elements 31, the depth of color of a raster line is uniform, and therefore, color variations do not occur. However, when the uniformity of the discharge performance of the 360 nozzle openings 51 is degraded, even in a case in which the same driving voltage is supplied to the piezoelectric elements 31, the amounts of the liquid droplets 63A and 63B that are discharged, fluctuates, and therefore, the depth of color of a raster line is not uniform, and color variation occurs.

In the abovementioned manner, in the first liquid droplet discharging operation, the ink 61 of a microscopic region in the vicinity of the center of the meniscus 62 that is drawn-in in a localized manner, is discharged as a liquid droplet 63A. That is, the first liquid droplet discharging operation discharges the ink 61 of a portion that is separated from the liquid-repellent film 43 as a liquid droplet 63A. In the first liquid droplet discharging operation, the meniscus 62 of the ink 61 that is discharged as a liquid droplet 63A, is separated from the liquid-repellent film 43, and therefore, it is difficult for the meniscus 62 to be subjected to the effects of the deterioration of the liquid-repellent film 43. Accordingly, in the first liquid droplet discharging operation, even if deterioration of the liquid-repellent film 43 is progressing, it is difficult for a defect of the uniformity of discharge performance of the 360 nozzle openings 51 becoming impaired, to occur.

Accordingly, even in a case in which deterioration of the liquid-repellent film 43 has progressed as a result of the wiping process, it is possible to form a normal image (a planned image) on the recording medium 10 using dots that are formed by the first liquid droplet discharging operation.

In the abovementioned manner, in the second liquid droplet discharging operation, since the ink 61 is discharged as a liquid droplet 63B by squirting out the entirety of the meniscus 62, the meniscus 62 of the ink 61 that is discharged as a liquid droplet 63B is disposed close to the liquid-repellent film 43, and therefore, it is easy for the meniscus 62 to be subjected to the effects of the deterioration of the liquid-repellent film 43. Accordingly, in the second liquid droplet discharging operation, when deterioration of the liquid-repellent film 43 progresses, the uniformity of discharge performance of the 360 nozzle openings 51 becomes impaired, and therefore, it is difficult to form a normal image (a target image) on the recording medium 10.

In this manner, in comparison with the second liquid droplet discharging operation, it is difficult for the first liquid droplet discharging operation to be subjected to the effects of the deterioration of the liquid-repellent film 43, and even in a case in which deterioration of the liquid-repellent film 43 is progressing, the performance of the recording head 25 is retained in a normal manner, and therefore, it is possible to form a normal image (a planned image) on the recording medium 10. In comparison with the first liquid droplet discharging operation, it is easy for the second liquid droplet discharging operation to be subjected to the effects of the deterioration of the liquid-repellent film 43, and in a case in which deterioration of the liquid-repellent film 43 is progressing, the performance of the recording head 25 deteriorates, and therefore, it is difficult to form a normal image (a target image) on the recording medium 10.

In the present embodiment, in a case in which the number of repetitions of the wiping process of the recording head 25 is low, and the deterioration state of the liquid-repellent film 43 is negligible with respect to a predetermined state, a target image is formed on the recording medium 10 by forming the three types of dot of different sizes (a large dot, a medium dot and a small dot) on the recording medium 10 using both the first liquid droplet discharging operation and the second liquid droplet discharging operation.

When both the first liquid droplet discharging operation and the second liquid droplet discharging operation are used, it is possible to improve the productivity of image formation by forming portions of a target image in which high resolution is not required using the second liquid droplet discharging operation, and it is possible to improve the resolution of the image by forming portions of a target image in which high resolution is required using the first liquid droplet discharging operation. Accordingly, it is possible to improve the performance of the printer 11.

Furthermore, in a case in which the number of repetitions of the wiping process of the recording head 25 is high, and the deterioration state of the liquid-repellent film 43 is severe with respect to the predetermined state, a target image is formed on the recording medium 10 by forming the three types of dot of different sizes (a large dot, a medium dot and a small dot) on the recording medium 10 using the first liquid droplet discharging operation only. That is, even in a case in which deterioration of the liquid-repellent film 43 is progressing, the printer 11 is activated stably for a long period of time by forming a target image on the recording medium 10 using the first liquid droplet discharging operation, and therefore, it is possible to improve the durability of the printer 11.

For example, determination of whether the deterioration state of the liquid-repellent film 43 is negligible with respect to the predetermined state, or the deterioration state of the liquid-repellent film 43 is severe with respect to the predetermined state is performed by forming a color patch (a test pattern for color measurement) on the recording medium 10 using the second liquid droplet discharging operation, performing color measurement of the corresponding color patch, and determining whether or not there are color variations in the corresponding color patch on the basis of a predetermined examination criteria.

To explain in more detail, in a case in which color variations are not found in the corresponding color patch, it is determined that the deterioration state of the liquid-repellent film 43 is negligible with respect to the predetermined state. In addition, in a case in which color variations are found in the corresponding color patch, it is determined that the deterioration state of the liquid-repellent film 43 is severe with respect to the predetermined state.

In other words, as long as the image quality (quality) of an image that is formed by the second liquid droplet discharging operation is a good appearance quality (is normal), which is allowed, it is determined that the deterioration state of the liquid-repellent film 43 is negligible with respect to the predetermined state. In addition, as long as the image quality (quality) of an image that is formed by the second liquid droplet discharging operation is a poor appearance quality (is abnormal), which is not allowed, it is determined that the deterioration state of the liquid-repellent film 43 is severe with respect to the predetermined state.

In addition, the examination criteria that determines whether the image quality (quality) of an image is normal or abnormal is established occasionally as a result of a request from a user, or the like.

In this manner, in the present embodiment, the first liquid droplet discharging operation and the second liquid droplet discharging operation are used for different purposes depending on the deterioration state of the liquid-repellent film 43. That is, in a case in which the deterioration state of the liquid-repellent film 43 is negligible with respect to the predetermined state, a target image is formed on the recording medium 10 using both the first liquid droplet discharging operation and the second liquid droplet discharging operation. In addition, in a case in which the deterioration state of the liquid-repellent film 43 is severe with respect to the predetermined state, a target image is formed on the recording medium 10 using the first liquid droplet discharging operation only.

In the abovementioned manner, the printer 11 according to the present embodiment is a printer that forms dots on the recording medium 10 by discharging the ink 61 from the nozzle formation surface 36A, in which the nozzle openings 51 are formed, as the liquid droplets 63A and 63B as a result of deforming the menisci 62 of the ink 61 inside the nozzles 52 using the piezoelectric elements 31, includes the liquid-repellent film 43 that covers the nozzle formation surface 36A, a wiping process that wipes away a stain of nozzle formation surface 36A, a first liquid droplet discharging operation that discharges the ink 61 that is separated from the wall surface 53 of the nozzle 52 and disposed on the inner side of the nozzle 52 as liquid droplets 63A, and a second liquid droplet discharging operation that discharges the ink 61 that is in contact with the wall surface 53 of the nozzle 52 and disposed on the inner side of the nozzle 52 as liquid droplets 63B, and the first liquid droplet discharging operation and the second liquid droplet discharging operation are used for different purposes depending on the deterioration state of the liquid-repellent film 43.

Estimation Section

Next, a summary of the estimation section 460 will be described.

Deterioration of the liquid-repellent film 43 progresses as a result of repetition of the wiping process that wipes away a stain of the nozzle formation surface 36A using the wiping member. Since there is a correlative relationship between the number of repetitions of the wiping process and the deterioration state of the liquid-repellent film 43, it is possible to estimate the deterioration state of the liquid-repellent film 43 from the number of repetitions of the wiping process.

A number of repetitions of the wiping process at which the deterioration state of the liquid-repellent film 43 becomes severe with respect to the predetermined state is registered in the estimation section 460 (refer to FIG. 1). Furthermore, it is possible for a user to update the number of repetitions of the wiping process at which the deterioration state of the liquid-repellent film 43 becomes severe with respect to the predetermined state that is registered in the estimation section 460 from maintenance information of the printer 11, maintenance information of another printer 11, or the like, in a manner in which more correct estimation can be carried out.

The estimation section 460 adds up the number of repetitions of the wiping process. In a case in which the added number of repetitions of the wiping process, does not exceed a registered number of repetitions of the wiping process at which deterioration of the liquid-repellent film 43 occurs, the estimation section 460 estimates that the deterioration state of the liquid-repellent film 43 is negligible with respect to the predetermined state. Furthermore, in a case in which the added number of repetitions of the wiping process, exceeds a registered number of repetitions of the wiping process at which deterioration of the liquid-repellent film 43 occurs, the estimation section 460 estimates that the deterioration state of the liquid-repellent film 43 is severe with respect to the predetermined state.

In a case in which the estimation section 460 estimates that the deterioration state of the liquid-repellent film 43 is negligible with respect to the predetermined state, the printer 11 forms the three types of dot of different sizes (a large dot, a medium dot and a small dot) on the recording medium 10 using both the first liquid droplet discharging operation and the second liquid droplet discharging operation.

In a case in which the estimation section 460 estimates that the deterioration state of the liquid-repellent film 43 is severe with respect to the predetermined state, the printer 11 forms the three types of dot of different sizes (a large dot, a medium dot and a small dot) on the recording medium 10 using the first liquid droplet discharging operation only.

In this manner, as a result of providing the estimation section 460 in the printer 11, and estimating the deterioration state of the liquid-repellent film 43, the printer 11 can form an image on the recording medium 10 with a preferable liquid droplet discharging operation on the basis of the estimation result of the deterioration state of the liquid-repellent film 43. Accordingly, the use of an unfavorable liquid droplet discharging operation is prevented from occurring, and therefore, it is possible to prevent the occurrence of loss due to the use of an unfavorable liquid droplet discharging operation.

Additionally, the deterioration of the liquid-repellent film 43 changes depending on the color material that is included in the ink 61. In a case in which the color material is a pigment or an inorganic material (for example, a white pigment), in comparison with a case in which the color material is a dye, it is easy for the liquid-repellent film 43 to be subjected to mechanical damage as a result of the wiping process that wipes away a stain of the nozzle formation surface 36A. That is, in a case in which the ink 61 includes a pigment or an inorganic material (for example, a white pigment), in comparison with a case in which the ink 61 includes a dye and does not include a pigment or an inorganic material, it is easy for deterioration of the liquid-repellent film 43 to occur.

Accordingly, it is preferable that a number of repetitions of the wiping process at which deterioration of the liquid-repellent film 43 occurs, which is registered in the estimation section 460, is changed depending on the type of color material that is included in the ink 61. For example, since the number of repetitions of the wiping process at which deterioration of the liquid-repellent film 43 occurs, differs for pigment ink and dye ink, it is preferable that the number of repetitions of the wiping process at which deterioration of the liquid-repellent film 43 occurs is changed for pigment ink and dye ink.

Embodiment 2

Summary of Printer

Figure 7:
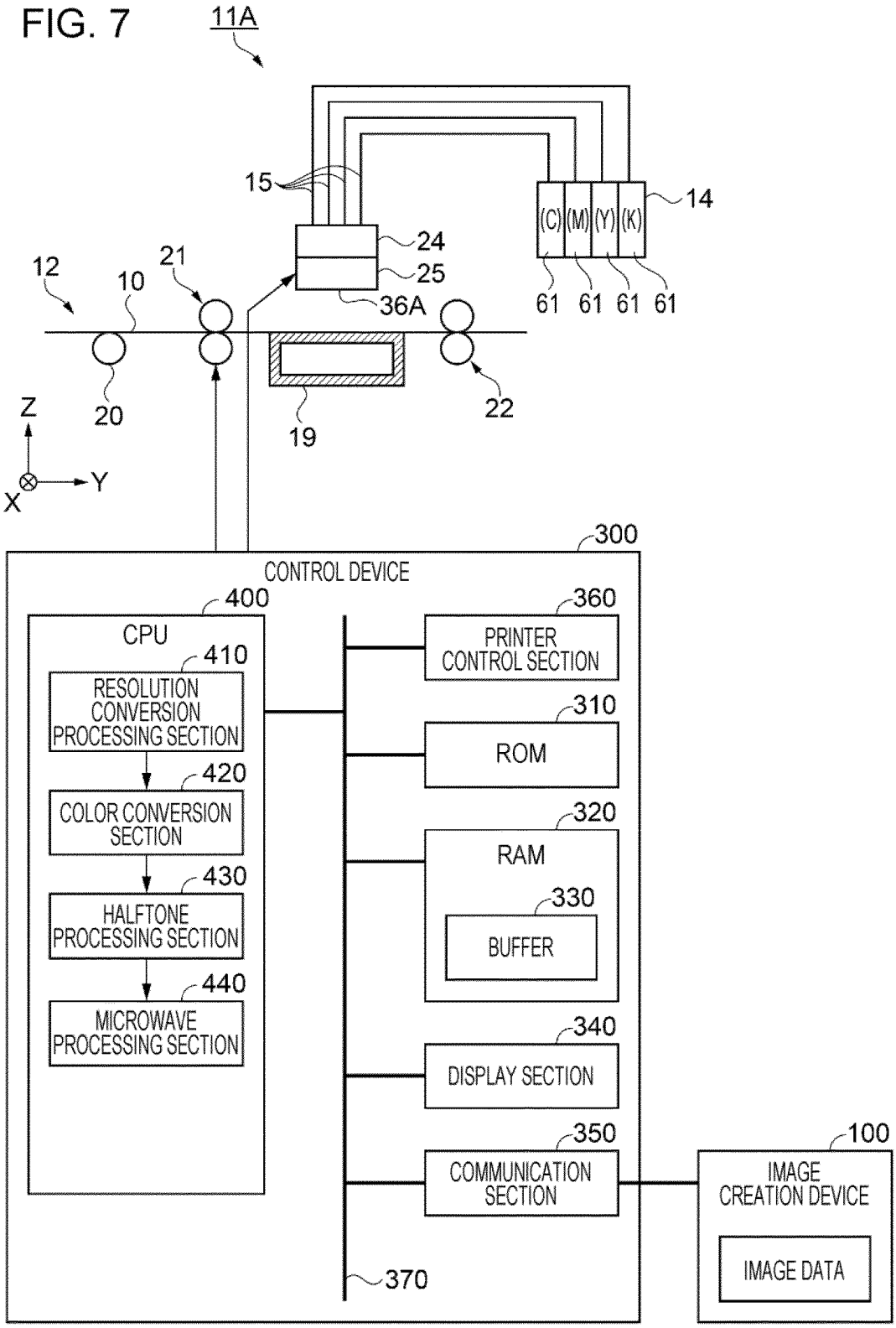
FIG. 7 is a schematic view that shows a summary of a printer according to Embodiment 2.

FIG. 7 is a schematic view that shows a summary of a printer according to Embodiment 2.

Hereinafter, a printer 11A according to the present embodiment will be described with reference to FIG. 7 focusing on the points that differ from Embodiment 1. In addition, constituent sites that are the same as those of Embodiment 1 will be given the same reference numerals, and overlapping descriptions thereof will be omitted.

As shown in FIG. 7, the printer 11A according to the present embodiment is provided with a transport unit 12 and a recording head 25. In addition, the printer 11A is provided with a control device 300 that controls the transport unit 12 and the recording head 25, four cartridges 14 that supply the ink 61 to the recording head 25, and a valve unit 24 that controls the flow pressure of the ink 61, which is supplied to the recording head 25.

The control device 300 is provided with a CPU 400, a ROM 310, a RAM 320, a display section 340, a communication section 350 and a printer control section 360. The CPU 400, the ROM 310, the RAM 320, the communication section 350 and the printer control section 360 are connected to one another through a bus 370.

The CPU 400 is provided with the resolution conversion process section 410, a color conversion section 420, a halftone process section 430, a microwave process section 440, and the like as functional portions that are realized by software (programs).

That is, the printer 11A according to the present embodiment does not include the estimation section 460, and the printer 11 according to Embodiment 1 does includes the estimation section 460. This feature is a difference between the present embodiment and Embodiment 1, and the other constituent elements are the same for the present embodiment and Embodiment 1.

Furthermore, the liquid droplet discharging operations differ for the printer 11A according to the present embodiment and the printer 11 according to Embodiment 1.

To explain in more detail, the printer 11A according to the present embodiment forms the three types of dot of different sizes (a large dot, a medium dot and a small dot) on the recording medium 10 using the first liquid droplet discharging operation only. The printer 11 according to Embodiment 1 forms the three types of dot of different sizes (a large dot, a medium dot and a small dot) on the recording medium 10 using both the first liquid droplet discharging operation and the second liquid droplet discharging operation in a case in which the deterioration state of the liquid-repellent film 43 is negligible with respect to the predetermined state, and forms the three types of dot of different sizes (a large dot, a medium dot and a small dot) on the recording medium 10 using the first liquid droplet discharging operation only in a case in which the deterioration state of the liquid-repellent film 43 is severe with respect to the predetermined state.

Since the printer 11A according to the present embodiment forms dots on the recording medium 10 using the first liquid droplet discharging operation, in which it is difficult for discharge to be subjected to the effects of the deterioration of the liquid-repellent film 43, only, in comparison with the printer 11 according to Embodiment 1, which includes the second liquid droplet discharging operation, in which it is easy for discharge to be subjected to the effects of the deterioration of the liquid-repellent film 43, the uniformity of the discharge performance of the recording head 25 is impaired as a result of the deterioration of the liquid-repellent film 43 proceeding, and therefore, it is possible to suppress a defect of color variations occurring in an image that is formed on the recording medium 10, more forcibly. That is, the printer 11A according to the present embodiment can form a target image more stably than the printer 11 according to Embodiment 1.

Since the printer 11A according to the present embodiment forms dots on the recording medium 10 using the first liquid droplet discharging operation, in which a stable operation is possible over a long period of time, only, in comparison with the printer 11 according to Embodiment 1, which includes the second liquid droplet discharging operation, in which it is difficult to perform a stable operation over a long period of time, the printer 11A is activated stably over a long period of time, and therefore, it is possible to further improve the durability of the printer 11A.

In this manner, when dots are formed on the recording medium 10 using the first liquid droplet discharging operation, in which it is difficult for discharge to be subjected to the effects of the deterioration of the liquid-repellent film 43, only, since the printer 11A is activated stably over a long period of time, and therefore, it is possible to further improve the durability of the printer 11A, the present embodiment is suitable in a case in which the ink 61 in which it is easy for deterioration of the liquid-repellent film 43 to occur is used (for example, a case in which a pigment ink is used).

In the abovementioned manner, the printer 11A according to the present embodiment is a printer that forms dots on the recording medium 10 by discharging the ink 61, as liquid droplets 63A, from the nozzle formation surface 36A, in which the nozzle openings 51 are formed, as a result of deforming the menisci 62 of the ink 61 in the nozzles 52 using the piezoelectric elements 31, includes the liquid-repellent film 43 that covers the nozzle formation surface 36A, a wiping process that wipes away a stain on the nozzle formation surface 36A, and forms the three types of dot of different sizes (a large dot, a medium dot and a small dot) on the recording medium 10 using the first liquid droplet discharging operation, which discharges the ink 61, which is separated from the wall surface 53 of the nozzle 52 and disposed on the inner side of the nozzles 52, as the liquid droplets 63A.

Embodiment 3

The ink 61 may be an ink having strong corrosive properties. For example, the ink 61 in Embodiment 3 is an alkaline ink or an acidic ink, and there is a concern that chemical deterioration of the liquid-repellent film 43 and the nozzle formation surface 36A will occur.

To explain in more detail, the ink 61 includes a color material such as a dye or a pigment, water, a water-soluble organic solvent, a pH adjuster, and the like. For example, as the water-soluble organic solvent, it is possible to use ethylene glycol, propylene glycol, diethylene glycol, dipropylene glycol, glycerin, triethylene glycol, ethanol, propanol, or the like. For example, as the pH adjuster, it is possible to use sodium hydroxide, potassium hydroxide, sodium acetate, sodium carbonate, sodium bicarbonate, an alkanolamine, hydrochloric acid, acetic acid, or the like.

In a case in which sodium hydroxide, potassium hydroxide, sodium acetate, sodium carbonate, sodium bicarbonate, an alkanolamine, or the like is used as the pH adjuster, the ink 61 has an alkaline property, and is an alkaline ink (liquid) for which there is a fear that chemical damage (chemical deterioration) of the liquid-repellent film 43 and the nozzle formation surface 36A will occur.

In a case in which hydrochloric acid, acetic acid, or the like is used as the pH adjuster, the ink 61 has an acidic property, and is an acidic ink (liquid) for which there is a fear that chemical damage (chemical deterioration) of the liquid-repellent film 43 and the nozzle formation surface 36A will occur.

In the abovementioned manner, the liquid-repellent film 43 is formed from a fluorine-containing organic compound, a fluorine-containing organosilicon compound, or the like. In the liquid-repellent film 43, a silicon resin and a fluororesin have structures that are bonded together by a substituent such as a methylene group (CH2). Therefore, the liquid-repellent film 43 includes a portion in which silicon (Si) and oxygen (O) are bonded together (a silicon resin) that is disposed on a nozzle formation surface 36A side, a portion in which carbon (C) and fluorine (F) are bonded together (a fluororesin) that is disposed on a surface side that is opposite to the nozzle formation surface 36A, and a portion in which carbon (C) and carbon (C), which bond together the silicon resin and the fluororesin, are bonded together. Further, the portion in which the carbon (C) and the fluorine (F) are bonded together (the fluororesin) comes into contact with the ink 61, and controls the position and shape of the meniscus 62 of the ink 61.

However, since a bonding energy of the carbon (C) and the carbon (C) is smaller than a bonding energy of the silicon (Si) and the oxygen (O), and a bonding energy of the carbon (C) and the fluorine (F), in comparison with the portion in which the silicon (Si) and the oxygen (O) are bonded together, and the portion in which the carbon (C) and the fluorine (F) are bonded together, in the portion in which the carbon (C) and the carbon (C) are bonded together, the bonding is weak, and therefore, it is easier for this portion to be subjected to the effects of mechanical damage and chemical damage.

Furthermore, when the film thickness of the liquid-repellent film 43 is set to be thick (for example, when set to approximately 300 μm or more), it is possible to form a liquid-repellent film 43 in which pinholes are suppressed, but since it is easy for the liquid-repellent film 43 to peel away, the film thickness of the liquid-repellent film 43 (the fluororesin) is thinner than approximately 300 μm. Therefore, there are microscopic pinholes in the liquid-repellent film 43.

In the abovementioned manner, in the liquid droplet discharging operations, a portion of the liquid droplets 63A and 63B that are discharged from the nozzle formation surface 36A does not land on the recording medium 10, and instead forms ink mist, and becomes airborne. Therefore, the liquid-repellent film 43 that covers the nozzle formation surface 36A is bleached in an atmosphere of ink mist that is formed from the ink 61. Furthermore, as a result of the liquid droplet discharging operations, the liquid-repellent film 43 in the vicinity of the opening edges of the nozzle openings 51 is bleached by the ink 61 (refer to FIGS. 5B to 5D and FIGS. 6B to 6D).

In a case in which an ink having strong corrosive properties is used as the ink 61, and the liquid-repellent film 43 is bleached in an atmosphere of ink mist that is formed from the ink 61, there is a concern that the liquid-repellent film 43 will deteriorate as a result of the ink 61 (the ink mist) seeping into the liquid-repellent film 43 via the pinholes thereof, the base material of the nozzle formation surface 36A being subjected to chemical damage (being degraded chemically) due to the ink 61, and the liquid-repellent film 43 peeling away in a localized manner.

Furthermore, there is a concern that the liquid-repellent film 43 will deteriorate as a result of the portion in which the carbon (C) and the carbon (C) are bonded together being subjected to chemical damage (being degraded chemically) by ink 61 that seeps into the liquid-repellent film 43 via the pinholes thereof, and the fluororesin, which configures the liquid-repellent film 43, peeling away in a localized manner.

Furthermore, since the liquid-repellent film 43 in the vicinity of the of the opening edges of the nozzle openings 51 is bleached by the ink 61, there is a concern that the liquid-repellent film 43 will deteriorate as a result of the liquid-repellent film 43 in the vicinity of the of the opening edges of the nozzle openings 51 being subjected to chemical damage (being degraded chemically) by the ink 61, and the liquid-repellent film 43 peeling away in a localized manner.

In this manner, when an ink having strong corrosive properties is used as the ink 61, there is a concern that deterioration of the liquid-repellent film 43 will progress as a result of the liquid-repellent film 43 being subjected to chemical damage (being degraded chemically). In addition, since deterioration of the liquid-repellent film 43 does not progress in a uniform manner, there is a concern that a defect such as the uniformity of the discharge performance of the recording head 25 becoming impaired, will occur.

In the abovementioned manner, there is also a concern that mechanical damage to the liquid-repellent film 43 will occur as a result of the wiping process that wipes away a stain that is attached to the nozzle formation surface 36A (the liquid-repellent film 43). In a case in which mechanical damage to the liquid-repellent film 43 occurs, there is a concern that the progression of deterioration of the liquid-repellent film 43 will be accelerated by a synergistic operation of the corresponding mechanical damage and the corresponding chemical damage. Furthermore, when dust is attached to the liquid-repellent film 43 and the dust is absorbed (retained) by ink having strong corrosive properties, in comparison with a case in which dust is not attached to the liquid-repellent film 43, there is a concern that the effects of chemical damage due to the ink 61 will become more pronounced, and therefore, that the progression of the deterioration of the liquid-repellent film 43 will be accelerated.

In a case in which the ink 61 is an ink having strong corrosive properties and the liquid-repellent film 43 deteriorates as a result of mechanical damage and chemical damage, when the above-mentioned configurations of Embodiment 1 and Embodiment 2 are applied, it is possible to suppress the adverse effects of deterioration of the liquid-repellent film 43 due to the ink 61. In particular, when dots are formed on the recording medium 10 using the first liquid droplet discharging operation, in which it is difficult for discharge to be subjected to the effects of the deterioration of the liquid-repellent film 43, only, the printer 11A is activated stably over a long period of time, and therefore, it is possible to further improve the durability of the printer 11A.

Additionally, an ink having strong corrosive properties is not limited to an alkaline ink or an acidic ink. For example, in a case in which there is a concern that chemical deterioration of the liquid-repellent film 43 and the nozzle formation surface 36A will occur as a result of a solvent that configures the ink 61, a solute that is dissolved in a solvent that configures the ink 61, a material that is dispersed in a solvent that configures the ink 61, or the like, the corresponding ink (liquid) corresponds to an ink (liquid) having strong corrosive properties.

For example, in a case in which the ink 61 is a non-aqueous ink that does not include an aqueous and instead, includes an organic solvent, in comparison with an aqueous ink that includes an aqueous solvent, it is easy for the portion in which the carbon (C) and the carbon (C) are bonded together (the portion in which bonding is weak) to be subjected to the effects of the organic solvent, and for example, it is easy for the liquid-repellent film 43 to deteriorate as a result of fluororesin peeling away easily due to the portion in which the carbon (C) and the carbon (C) are bonded together swelling and due to the organic solvent.

Even in a case in which the ink 61 is a non-aqueous ink, when the above-mentioned configurations of Embodiment 1 and Embodiment 2 are applied, it is possible to suppress the adverse effects of deterioration of the liquid-repellent film 43 due to the ink 61. In particular, when dots are formed on the recording medium 10 using the first liquid droplet discharging operation, in which it is difficult for discharge to be subjected to the effects of the deterioration of the liquid-repellent film 43, only, the printer 11A is activated stably over a long period of time, and therefore, it is possible to further improve the durability of the printer 11A.

Embodiment 4

The ink 61 may have a configuration that does not include a color material.

For example, the ink 61 may be a functional ink in which a functional material such as an organic EL material, a precursor to an organic EL material, or the like is dispersed in a medium. For example, the ink 61 may be a functional ink in which a functional material such as a semiconductor material, a precursor to a semiconductor material, or the like is dispersed in a medium. For example, the ink 61 may be a functional ink in which a functional material such as a conductive material, a precursor to a conductive material, or the like is dispersed in a medium. For example, the ink 61 may be a functional ink that is formed from a functional material such as a sol-gel precursor liquid (for example, a precursor liquid of PZT (lead zirconate titanate)).

For example, the ink 61 may be a developing liquid or an etching liquid. For example, the ink 61 may be an adhesive agent. For example, the ink 61 may be a resin or an oil. For example, the ink 61 may be a resin having a photosensitive property, a resin that is colored, or the like. For example, the ink 61 may be a single solvent, a mixture of a plurality of solvents, or the like.

Even in a case in which the ink 61 includes a functional material, a developing liquid, an etching liquid, an adhesive agent, a resin, an oil, a resin having a photosensitive property, a resin that is colored, or the like, there is a concern that the liquid-repellent film 43 will deteriorate as a result of mechanical damage and chemical damage that is caused by the corresponding ink 61. In a case in which the liquid-repellent film 43 deteriorates as a result of such mechanical damage and chemical damage, when the above-mentioned configurations of Embodiment 1 and Embodiment 2 are applied, it is possible to suppress the adverse effects of deterioration of the liquid-repellent film 43 due to the ink 61. In particular, when dots are formed on the recording medium 10 using the first liquid droplet discharging operation, in which it is difficult for discharge to be subjected to the effects of the deterioration of the liquid-repellent film 43, only, the printer 11A is activated stably over a long period of time, and therefore, it is possible to further improve the durability of the printer 11A.

In the abovementioned manner, as a result of the present application, a defect of the uniformity of the discharge performance of the recording head 25 being impaired due to the liquid-repellent film 43 deteriorating as a result of mechanical damage due to the wiping process that wipes away a stain that attaches to the nozzle formation surface 36A (the liquid-repellent film 43) and chemical damage due to being bleached by ink mist that is formed from the ink 61 and liquid, is suppressed, and therefore, it is possible to realize a liquid discharging apparatus having a high appearance quality and high reliability.

Furthermore, it is possible to apply the present application to a liquid discharging apparatus (a textile printing apparatus) that performs textile printing on a fabric, a liquid discharging apparatus that discharges a liquid in which a material such as an electrode material or a color material, which is used in the manufacture of a liquid crystal display, an electroluminescence (EL) displays, a surface-emitting display, a color filter, or the like, is dispersed or dissolved, a liquid discharging apparatus that discharges a liquid that includes living organic material, which is used in the manufacture of biochips, a liquid discharging apparatus that discharges a liquid that corresponds to a specimen, which is used as a precision pipette, a liquid discharging apparatus that discharges an oil (a lubricating oil) with pinpoint precision in a precision instrument such as a watch or a camera, a liquid discharging apparatus that discharges a transparent resin liquid such as an ultraviolet curable resin for forming a microhemispherical lens (an optical lens) or the like, which is used in optical communication elements or the like, onto a substrate, a liquid discharging apparatus that discharges an etching liquid such as an acid or an alkali for etching a substrate or the like, or the like.

Furthermore, the liquid discharging apparatus in the present application is not limited to the above-mentioned serial technique printers 11 and 11A that record images while moving the recording head 25 in the scanning direction (the X direction), and for example, may be a line technique printer that records an image in a state in which the recording head 25 is fixed.

The entire disclosure of Japanese Patent Application No. 2015-178236, filed Sep. 10, 2015 and Japanese Patent Application No. 2015-218095, filed Nov. 6, 2015 are expressly incorporated by reference herein in its entirety.

What is claimed is:

1. A liquid discharging apparatus comprising:

a nozzle;

a nozzle formation surface in which an opening of the nozzle is formed;

a liquid-repellent film that covers the nozzle formation surface;

a piezoelectric element;

a wiping member configured to perform a wiping process to wipe away a stain on the nozzle formation surface; and a control section programmed to supply a driving signal to the piezoelectric element so as to cause the liquid discharging apparatus to form dots on a recording medium by discharging a liquid, as liquid droplets, from the nozzle formation surface as a result of deforming a meniscus of the liquid in the nozzle, wherein the control section is programmed to perform: (i) a first liquid droplet discharging operation in which a portion of the liquid that forms the liquid droplets is separated by a space from a portion of the liquid that forms the meniscus and contacts a wall surface of the nozzle, and (ii) a second liquid droplet discharging operation in which a portion of the liquid that forms the liquid droplets is not separated by a space from a portion of the liquid that forms the meniscus and contacts a wall surface of the nozzle, and wherein the control section is programmed to operate using both the first liquid droplet discharging operation and the second liquid droplet discharging operation when a deterioration state of the liquid-repellant film is less than a predetermined deterioration state, and the control section is programmed to operate using only the first liquid droplet discharging operation when the deterioration state of the liquid-repellant film is greater than the predetermined deterioration state.

2. The liquid discharging apparatus according to claim 1, further comprising:

an estimation section programmed to estimate the deterioration state of the liquid-repellent film based on a determined number of repetitions of the wiping process performed by the wiping member.

* * * * *